US009528193B2

(12) United States Patent
Yang et al.

(10) Patent No.: US 9,528,193 B2
(45) Date of Patent: Dec. 27, 2016

(54) DIRECT-CURRENT SHUNT PREHEATING START METHOD FOR AN INERT ELECTRODE ALUMINUM ELECTROLYSIS CELL

(71) Applicant: ALUMINUM CORPORATION OF CHINA LIMITED, Beijing (CN)

(72) Inventors: Jianhong Yang, Zhenghou (CN); Shengzhong Bao, Zhengzhou (CN); Peng Cao, Zhengzhou (CN); Xinping Tang, Zhengzhou (CN)

(73) Assignee: Aluminum Corporation of China Limited, Beijing (CN)

( * ) Notice: Subject to any disclaimer, the term of this patent is extended or adjusted under 35 U.S.C. 154(b) by 103 days.

(21) Appl. No.: 14/400,305

(22) PCT Filed: Dec. 26, 2012

(86) PCT No.: PCT/CN2012/087478

§ 371 (c)(1),
(2) Date: Nov. 10, 2014

(87) PCT Pub. No.: WO2014/015638

PCT Pub. Date: Jan. 30, 2014

(65) Prior Publication Data

US 2015/0136612 A1 May 21, 2015

(30) Foreign Application Priority Data

Jul. 27, 2012 (CN) ..... 2012 1 0262136

(51) Int. Cl.

| | |
|---|---|
| ***C25C 3/20*** | (2006.01) |
| ***C25C 3/24*** | (2006.01) |
| ***C25C 3/08*** | (2006.01) |
| ***C25C 3/16*** | (2006.01) |

(52) U.S. Cl.
CPC . *C25C 3/24* (2013.01); *C25C 3/08* (2013.01); *C25C 3/16* (2013.01); *C25C 3/20* (2013.01)

(58) Field of Classification Search
USPC ..... 205/390
See application file for complete search history.

(56) References Cited

U.S. PATENT DOCUMENTS

| | | | | |
|---|---|---|---|---|
| 6,537,438 | B2 | 3/2003 | Christini | |
| 7,485,215 | B2 | 2/2009 | Jouaffre et al. | |
| 2002/0079231 | A1* | 6/2002 | Nora | C25C 3/06 205/230 |
| 2003/0057102 | A1* | 3/2003 | Beck | C25C 3/06 205/376 |
| 2004/0011661 | A1* | 1/2004 | Bradford | C25C 3/06 205/385 |

FOREIGN PATENT DOCUMENTS

| | | | |
|---|---|---|---|
| CN | 1250113 | A | 4/2000 |
| CN | 1831198 | A | 9/2006 |
| CN | 201186954 | Y | 1/2009 |
| CN | 101709484 | A | 5/2010 |
| CN | 201762461 | U | 3/2011 |
| CN | 102808196 | A | 12/2012 |

OTHER PUBLICATIONS

Kvande et al, The Aluminum Smelting Process and Innovative Alternative Technologies, Journal of Occupational and Environmental Medicine, vol. 56, No. 5S, May 2014, pp. S23-S32.*
Machine Translation of CN101709484A.*
Machine Translation of CN102234819B.*
Machine Translation of CN201186954Y.*
Machine Translation of CN201762461U.*
"International Search Report dated Mar. 14, 2013," International Application No. PCT/CN2012/087478, 2 pages.

* cited by examiner

*Primary Examiner* — Harry D Wilkins, III
(74) *Attorney, Agent, or Firm* — Hogan Lovells LLP

(57) ABSTRACT

The invention discloses a direct-current shunt preheating start method for an inert electrode aluminum electrolysis cell, comprising: (1) forming multiple groups of direct-current shunt elements by using conductors with preset resistance values and geometric sizes; (2) laying in a hearth of the electrolysis cell electrical heating element groups of the same number as/a different number from electrode groups; (3) drying the hearth, smelting electrolyte and establishing a thermal balance and a hearth inner profile by using the electrical heating element groups according to a set heating curve or set steps; (4) changing the number of groups/a series or parallel connection state of the direct-current shunt elements; and (5) gradually replacing inert electrodes and gradually adjusting the number of the groups of/the series or parallel connection state of the shunt elements. By means of the present invention, the inert electrode aluminum electrolysis cell can be well preheated and the thermal balance can be established; in the inert electrode replacement process, stability of the cell voltage can further be ensured, so that the current passing through the inert electrodes in the cell is uniform; and series current is not affected by start of a single electrolysis cell, so that non-disturbance start is implemented.

10 Claims, No Drawings

DIRECT-CURRENT SHUNT PREHEATING START METHOD FOR AN INERT ELECTRODE ALUMINUM ELECTROLYSIS CELL

RELATED APPLICATIONS

This application is a United States National Stage Application filed under 35 U.S.C 371 of PCT Patent Application Serial No. PCT/CN2012/087478, filed Dec. 26, 2012, which claims Chinese Patent Application Serial No. CN201210262136.0, filed Jul. 27, 2012, the disclosure of all of which are hereby incorporated by reference in their entirety.

TECHNICAL FIELD

The present invention belongs to the field of aluminum smelting and relates to a preheating start method which is suitable for an inert electrode aluminum electrolysis cell.

BACKGROUND OF THE INVENTION

Preheating start is a necessary important process before an aluminum electrolysis cell enters normal operation. Main effects of the preheating start comprise drying and baking a hearth, melting electrolyte, enabling temperature and depth of the liquid electrolyte to achieve target values, establishing energy balance and material balance and the like. The preheating start is mainly used for providing a necessary operating environment before electrodes enter an operation state.

Traditional common preheating start methods for pre-baking anodic aluminum electrolysis cells comprise coke particle baking, aluminum liquid baking, fuel gas baking and the like. Although the forms of these baking methods are different, anodes need to participate in baking Furthermore, a later-stage management period with high voltage, high molecular ratio and high electrolysis temperature is needed after baking to establish energy balance and material balance, and then the electrolysis cells can be really started.

For the inert electrode aluminum electrolysis cells, as inert electrodes can not directly participate in baking frequently and further need to work in a stable environment, the operation effects and the service life of the insert electrodes can be ensured. The traditional preheating start method for the aluminum electrolysis cell can not be directly used on the inert electrode aluminum electrolysis cell.

In the prior patent documents, the baking start for the inert anodic electrolysis cells mostly indirectly continues to use the traditional methods, in particular to a baking stage.

In the description of Patent Application No. 200510031315.3, an inert anode is contained in a tank body, the tank body adopts a graphite or carbon product, and an electrode after containing is the same as a carbon anode and can be used in baking start or electrode change to avoid the impact of heat, electricity and thermal corrosive gas. The tank body can be consumed away after electrification, and when the inert electrode is exposed, the electrode is naturally transited to a working state.

In the description of Patent Application No. 01820302.7, a plurality of inert electrodes are combined together and insulating material is further added to form the shape which is similar to that of the carbon anode. The combination of each group of inert electrodes can replace one or more carbon anodes in an existing cell. In this patent application, it is disclosed that the carbon anode is firstly used for baking start of the electrolysis cell, and after the operation of the electrolysis cell is stable, the inert anode group is further used for replacement.

In the description of U.S. Pat. No. 6,537,438, when the electrolysis cell is subject to preheating start, a protecting layer is coated outside a cathode. The innermost layer in the protecting layer, which is in contact with the carbon cathode, is a boronizing soft layer, the intermediate layer is metal aluminum or an alloy and the outermost layer is carbon. By adopting a gas baking method, the anode is a metal ceramic anode. The protecting layer of the anode is from the oxidation in the baking process so as to oxidize the surface layer.

It can be seen from these patents that, at present, certain measures are taken for baking start of the inert electrolysis cell, then the traditional baking method can be indirectly adopted and the starting process is not considered too much. A preheating start method for an inert electrode aluminum electrolysis cell was illustrated in the prior patents by the inventors of the present patent application.

Patent Application No. 200910243383.4 provides a preheating start method for an inert anode aluminum electrolysis cell, which is mainly as follows: laying in a hearth electrical heating components (direct current or alternating current power supply) which are consistent with groups of electrodes in number, filling the hearth with electrolyte, heating and melting the electrolyte, and continuously adding the electrolyte to meet the required level. Then, the power of the heating components is reduced, the heating amount of the electrolysis cell in normal operation is simulated and after various technological parameters are stable, inert electrodes are gradually used for replacing heating resistors.

Patent Application No. 201110221899.6 provides a preheating start method for an aluminum electrolysis cell. Heating elements are pre-buried into graphite/carbon electrodes to form preheating electrodes. The heating elements are adopted for heating for an early-stage oven and melting of electrolyte; before the replacement of normal electrodes, direct current passes through the preheating electrodes and the preheating electrodes undergoes electrolysis reaction; and the preheating electrodes are extracted one by one to replace the normal electrodes for operation. The preheating start method can be applied to not only a traditional pre-baked carbon anode electrolysis cell, but also an inert electrode aluminum electrolysis cell.

In the above two patent applications, the inventors of the present patent illustrate the preheating start technology for pre-establishing energy balance and pre-establishing an inert electrode operating environment so as to enable the inert electrodes to be capable of operating in a stable environment after electrification. But the shortcomings are as follows: the preheating start method described in Patent Application No. 200910243383.4 is designed for the effects of series electrolysis cells on series current; and after the electrolysis reaction of the graphite/carbon electrode in Patent Application No. 201110221899.6 by passage of a direct current, the graphite/carbon electrode itself can be gradually consumed. On the one hand, it is required to change the graphite/carbon electrodes to be the inert electrodes within a short period of time; and otherwise, the consumption is completed. On the other hand, shedding carbon residue can pollute the electrolyte and is unfavorable for the inert anodes. These unfavorable factors can enable the preheating start process to be non-smooth and produce disturbance on the series electrolysis cells or the electrolysis cell.

SUMMARY OF THE INVENTION

The technical problem to be solved in the present invention is to provide a preheating start method which is suitable for an inert electrode aluminum electrolysis cell, which can be used for preheating a hearth, melting electrolyte and pre-establishing thermal balance and a good hearth inner profile, and can keep cell voltage and current distribution in the inert electrode replacement process relatively balanced, prevent affecting series electrolysis cell current by single cell start and realize non-disturbance preheating start.

In order to solve the above technical problem, the present invention provides a direct-current shunt preheating start method for an inert electrode aluminum electrolysis cell, comprising:

(1) forming multiple groups of direct-current shunt elements by using conductors with preset resistance values and geometric sizes, wherein the direct-current shunt elements can share all direct current of the electrolysis cell;

(2) laying in a hearth of the electrolysis cell electrical heating element groups of the same number as/a different number from electrode groups;

(3) drying the hearth, smelting electrolyte and establishing a thermal balance and a hearth inner profile by using the electrical heating element groups according to a set heating curve or set steps to provide an operating environment for inert electrodes;

(4) changing the number of groups/a series or parallel connection state of the direct-current shunt elements to adjust the cell voltage and enable the cell voltage to be the same as the voltage when in working by electrification after replacement of the inert electrodes; and (5) gradually replacing the inert electrodes and gradually adjusting the number of the groups/the series or parallel connection state of the shunt elements to keep the cell voltage stable, ensure uniform and stable direct current passing through the inert electrodes and prevent damage to the inert electrodes, wherein the shunt elements stop shunting and the inert electrodes bear all of the direct current till the replacement of all the inert electrodes is completed.

The direct-current shunt preheating start method for the inert electrode aluminum electrolysis cell provided in the present invention adopts the direct-current shunt elements, so that the total direct current can not change in the preheating start process of the single electrolysis cell and the series electrolysis cell current is not affected; and simultaneously, each inert electrode can keep its own cell voltage stable in the replacement process, so that the current passing through the above inert electrodes is uniform.

DETAILED DESCRIPTION OF THE PRESENTLY PREFERRED EMBODIMENTS

The direct-current shunt preheating start method for the inert electrode aluminum electrolysis cell in the preferred embodiment of the present invention comprises:

(1) forming multiple groups of direct-current shunt elements by using conductors with preset resistance values and geometric sizes, wherein the direct-current shunt elements can share all direct current of the electrolysis cell;

(2) laying in a hearth of the electrolysis cell electrical heating element groups of the same number as/a different number from electrode groups, wherein the electrical heating element groups can adopt alternating current or direct current and heating units of the electrical heating element groups comprise or partially comprise or do not comprise the direct-current shunt elements in step (1);

(3) drying the hearth, smelting electrolyte and establishing a thermal balance and a hearth inner profile by using the electric heating element groups according to a set heating curve or set steps to provide an operating environment for inert electrodes;

(4) changing the number of groups/a series or parallel connection state of the direct-current shunt elements to adjust cell voltage, so as to enable the cell voltage to be the same as the voltage when in working by electrification after replacement of the inert electrodes; and (5) gradually replacing the inert electrodes and gradually adjusting the number of the groups/the series or parallel connection state of the shunt elements to keep the cell voltage stable, ensure uniform and stable direct current passing through the inert electrodes and prevent damage to the inert electrodes, wherein the shunt elements stop shunting and the inert electrodes bear all of the direct current till the replacement of all the inert electrodes is completed.

The direct-current shunt elements in step (1) share the heat emitted in the direct current process and all or part or none of the heat is used for performing preheating start of an oven in the cell or melting the electrolyte or establishing a thermal balance process, and all or part or none of the heat can also be used for an out-of-cell material drying furnace, an electrolyte melting furnace, a heating furnace or an oven.

Embodiment 1

Commercialized alloy materials are used as conductors to manufacture 18 groups of direct-current shunt elements, and after the 18 groups of direct-current shunt elements share all of the direct current of an electrolysis cell, the voltage value ranges from 2.70V to 3.84V (because of the resistance value changing with temperature); and the 18 groups of direct-current shunt elements are placed in an electrolyte melting furnace outside the electrolysis cell, and heat emitted by the direct-current shunt elements is used for melting electrolyte used by the electrolysis cell.

Each group of direct-current shunt elements comprises two conductive plates, which have the resistance values of 0.0031908Ω and 0.0055448Ω respectively and have the same appearance size of 600 mm*300 mm*12 mm. The resistance values are adjusted by different numbers and lengths of saw kerfs on the conductive plates. The two conductive plates can be used in parallel, or each conductive plate can be used alone.

18 groups of electric heating element groups (in the same number as electrode groups) are laid in a hearth of the electrolysis cell and alternating current is passed for heating; and the solid electrolyte is filled in the hearth, heating is performed according to a heating system and the temperature of the electrolyte in the hearth is 780° C. finally. The liquid electrolyte in the electrolyte melting furnace is continuously filled into the electrolysis cell till the electrolyte level is 38 cm. Then, the power of the electric heating element groups is reduced and the heating amount of the electrolysis cell in normal operation of the electrolysis cell is simulated. A fluoride salt is simultaneously replenished to adjust the components of the electrolyte. Energy balance is established after 48 hours and the thickness of a furnace wall is 6.8 cm.

The electric heating element groups are gradually extracted from the hearth of the electrolysis cell to replace inert electrodes; after the replacement of one group of inert electrodes is completed, one group of direct-current shunt elements is cut off to enable the current with the corresponding intensity to pass through the inert electrodes and keep the cell voltage value at about 3.8V; after the replacement of all the 18 groups of inert electrodes is completed, all the direct-current shunt elements are cut off and the inert electrodes bear all the direct current; and the final cell voltage value is 3.88V, the start is smooth, the series direct current has no changes, the cell voltage has no great fluctuations and the current distribution is uniform.

Embodiment 2

Self-made alloy materials are used as conductors to manufacture 18 groups of direct-current shunt elements; after the 18 groups of direct-current shunt elements share all of the direct current of an electrolysis cell, the voltage value ranges from 2.72V to 3.86V (because of the resistance value changing with temperature); and the 9 groups of direct-current shunt elements are placed in an electrolyte melting furnace outside the electrolysis cell, and heat emitted by the direct-current shunt elements is used for melting electrolyte used by the electrolysis cell; and another 9 groups of direct-current shunt elements are laid in a hearth of the electrolysis cell and used as the electric heating element groups, the overall external dimension of another 9 groups of direct-current shunt elements is the same with the overall external dimension of the electrical heating element groups.

Each group of direct-current shunt elements comprises two conductive plates, which have the resistance values of 0.0031908Ω and 0.0055448Ω respectively and have the same appearance size of 600 mm*300 mm*12 mm. The resistance values are adjusted by different numbers and lengths of saw kerfs on the conductive plates. The two conductive plates can be used in parallel, or each conductive plate can be used alone.

The 18 groups of electric heating elements (in the same number as the electrode groups) are laid in the hearth of the electrolysis cell; wherein 9 groups are constituted by the direct-current shunt elements and the shared direct current is used for heating; alternating current passes through another 9 groups of separate heating units (electrical heating tubes) for auxiliary heating; and the solid electrolyte is filled in the hearth, heating is performed according to a heating system and the temperature of the electrolyte in the hearth is 780° C. finally. The liquid electrolyte in the electrolyte melting furnace is continuously filled into the electrolysis cell and the solid electrolyte is replenished till the electrolyte level is 38 cm. Then, the power of the alternating current heating element groups is reduced to enable the total power to be close to the heating power of the electrolysis cell during normal operation. A fluoride salt is simultaneously replenished to adjust the components of the electrolyte. Energy balance is established after 48 hours and the thickness of a furnace wall is 6.0 cm.

The electric heating element groups are gradually extracted from the hearth of the electrolysis cell to replace inert electrodes; after the replacement of one group of inert electrodes is completed, one group of direct-current shunt elements is cut off to enable the current with the corresponding intensity to pass through the inert electrodes and keep the cell voltage value at about 3.8V; after the replacement of all the 18 groups of inert electrodes is completed, all the direct-current shunt elements are cut off and the inert electrodes bear all the direct current; and the final cell voltage value is 3.9V, the start is smooth, the series direct current has no changes, the cell voltage has no great fluctuations and the current distribution is uniform.

Embodiment 3

Self-made alloy materials are used as conductors to manufacture 18 groups of direct-current shunt elements; after the 18 groups of direct-current shunt elements share all of the direct current of an electrolysis cell, the voltage value ranges from 1.25V to 1.88V (because of the resistance value changing with temperature);

Each group of direct-current shunt elements comprises two conductive plates, which have the resistance values of 0.0018402Ω and 0.0038201Ω respectively and have the same appearance size of 600 mm*300 mm*12 mm. The resistance values are adjusted by different numbers and lengths of saw kerfs on the conductive plates. The two conductive plates can be used in parallel, or each conductive plate can be used alone.

The 18 groups of electric heating elements (in the same number as the electrode groups) are laid in the hearth of the electrolysis cell, all the 18 groups are constituted by the direct-current shunt elements and the shared direct current is used for heating; initially, all the shunt elements are connected in parallel to operate at the minimal heating power; as the temperature rises and due to the need of melting the electrolyte, parallel connection buses are continuously removed and the number of the direct-current shunt elements is reduced so as to increase the heating power; and finally, the temperature of the electrolyte in the hearth is 800° C., the electrolyte level is 40 cm and the temperature of the electrolyte is maintained unchanged by increasing or decreasing the working number of the direct-current shunt elements. A fluoride salt is simultaneously replenished to adjust the components of the electrolyte. Energy balance is established after 48 hours and the thickness of a furnace wall is 4.6 cm.

The electric heating element groups are gradually extracted from the hearth of the electrolysis cell to replace inert electrodes; the cell voltage value is maintained at about 3.8V by adjusting the working number of the direct-current shunt elements (e.g. 9 groups of direct-current shunt elements are working); when each two groups of inert electrodes are placed in the hearth of the electrolysis cell, then one group of direct-current shunt elements is cut off, this operation is repeated till the replacement of all the 18 groups of inert electrodes is completed, then all the direct-current shunt elements are cut off and the inert electrodes bear all the direct current; and in the replacement process, the cell voltage has only small fluctuations (300 mV-400 mV), the final cell voltage value is 3.86V, the start is smooth, the series direct current has no changes, the cell voltage has no great fluctuations and the current distribution is uniform.

The above embodiments are three different implementation ways of a direct-current shunt preheating start method for an inert electrode aluminum electrolysis cell of the present invention, but the present invention is not limited to the above specific embodiments. The changes and the combinations of the specific forms, including the changes in the materials, the resistance values, the shapes, the sizes, the numbers, the placing ways and the heat application types of the direct-current shunt elements, as well as the changes in the ways of matching the heating element groups with the direct-current shunt element groups for use, the shapes and the arrangements should be included in the scope of the claims of the invention.

What is claimed is:

1. A direct-current shunt preheating start method for an inert electrode aluminum electrolysis cell, comprising:

(1) forming multiple groups of direct-current shunt elements by using conductors with preset resistance values and geometric sizes, wherein the direct-current shunt elements can share all direct current of the electrolysis cell;

(2) laying electrical heating element groups of the same number as, or a different number from, electrode groups in a hearth of the electrolysis cell;

(3) drying the hearth, smelting electrolyte and establishing a thermal balance and a hearth inner profile by using the electrical heating element groups according to a set heating curve or set steps to provide an operating environment for inert electrodes;

(4) changing the number of groups or a series or parallel connection state of the direct-current shunt elements to permit setting of the voltage which resulted from the shunt current to be the same as the cell voltage of the aluminum electrolysis cell when working by electrification after replacement of the inert electrodes; and (5) gradually replacing the shunt elements by the inert electrodes and gradually adjusting the number of the groups or the series or parallel connection state of the shunt elements to keep the cell voltage stable, ensure uniform and stable direct current passing through the inert electrodes and prevent damage to the inert electrodes, wherein the inert electrodes do not bear all of the direct current until all of the shunt elements stop shunting and all of the inert electrodes are replaced.

2. The direct-current shunt preheating start method for an inert electrode aluminum electrolysis cell of claim 1, wherein the electrical heating element groups adopt alternating current or direct current and heating units of the electrical heating element groups comprise or partially comprise or do not comprise the direct-current shunt elements in step (1).

3. The direct-current shunt preheating start method for an inert electrode aluminum electrolysis cell of claim 1, wherein the surfaces of the conductors of the direct-current shunt elements in step (1) adopt or do not adopt a corrosion-resistant material for protection and the erosion by a high-temperature electrolyte melt and an atmosphere in a preheating start period can be resisted.

4. The direct-current shunt preheating start method for an inert electrode aluminum electrolysis cell of claim 1, wherein the direct-current shunt elements in step (1) share heat emitted in the direct current process and all or part or none of the heat is directly dissipated in air.

5. The direct-current shunt preheating start method for an inert electrode aluminum electrolysis cell of claim 1, wherein the direct-current shunt elements in step (1) share the heat emitted in the direct current process and all or part or none of the heat is used for performing preheating start of an oven in the cell or melting the electrolyte or establishing a thermal balance process.

6. The direct-current shunt preheating start method for an inert electrode aluminum electrolysis cell of claim 1, wherein the direct-current shunt elements in step (1) share the heat emitted in the direct current process and all or part or none of the heat is used for an out-of-cell material drying furnace or an electrolyte melting furnace or a heating furnace or an oven.

7. The direct-current shunt preheating start method for an inert electrode aluminum electrolysis cell of claim 1, wherein the heating units of the electrical heating element groups in step (2) are constituted by separate heating resistors and heating power is changed by adjusting the supply power of alternating current or direct current power.

8. The direct-current shunt preheating start method for an inert electrode aluminum electrolysis cell of claim 1, wherein the heating units of the electrical heating element groups in step (2) are constituted by the direct-current shunt elements in step (1); and the overall resistance value and the heating power of the electrical heating element groups can be adjusted by changing the number of groups and the series or parallel connection state of the direct-current shunt elements.

9. The direct-current shunt preheating start method for an inert electrode aluminum electrolysis cell of claim 1, wherein the heating units of the electrical heating element groups in step (2) are jointly constituted by the heating resistors and the direct-current shunt elements in step (1); and the overall heating power of the electrical heating element groups is adjusted by changing the supply power of the heating resistors and the number of groups and the series or parallel connection state of the direct-current shunt elements.

10. The direct-current shunt preheating start method for an inert electrode aluminum electrolysis cell of claim 1, wherein the number of groups and the series or parallel connection state of the direct-current shunt elements in steps (1), (4) and (5) can be changed to ensure that the cell voltage can be stabilized in the vicinity of working voltage of the inert electrodes before and during replacement of the inert electrodes.

* * * * *